US005933116A

United States Patent [19]

Suesada et al.

[11] Patent Number: 5,933,116

[45] Date of Patent: Aug. 3, 1999

[54] CHIP ANTENNA

[75] Inventors: Tsuyoshi Suesada, Omihachiman; Kenji Asakura, Shiga-ken; Seiji Kanba, Otsu; Teruhisa Tsuru, Kameoka; Harufumi Mandai, Takatsuki, all of Japan

[73] Assignee: Murata Manufacturing Co., Ltd., Japan

[21] Appl. No.: 08/869,942

[22] Filed: Jun. 5, 1997

[30] Foreign Application Priority Data

Jun. 5, 1996 [JP] Japan ..... 8-143116

[51] Int. Cl.[6] ..... H01Q 1/24; H01Q 1/36

[52] U.S. Cl. ..... 343/702; 343/895

[58] Field of Search ..... 343/702; 427/126.3

[56] References Cited

U.S. PATENT DOCUMENTS 5,290,589 3/1994 Clough et al. ..... 427/126.3
5,767,811 6/1998 Mandai et al. ..... 343/702

FOREIGN PATENT DOCUMENTS 0706231 4/1996 European Pat. Off. .

OTHER PUBLICATIONS

Computers and Communications Technology Toward 2000, Seoul, Aug. 25–28, 1987, vol. 3, Aug. 25, 1987, Institute of Electrical and Electronics Engineers, pp. 1337–1341, XP000611342 Gosh, S.K. et al. "Microstrip Antenna on Ferrimagnetic Substrates in the Very High Frequency Range" p. 1339, col. 1, p. 1340, col. 2; table 1.

IEEE Transactions On Antennas and Propagation, vol. 41, No. 2, Feb. 1, 1993, pp. 230–233, XP000303632 Mishra, R.K. et al. "Tuning of Microstrip Antenna on Ferrite Substrate" p. 232, col. 1.

Electronics Letters, Oct. 9, 1980, U.K. vol. 16, No. 21, ISSN 0013–5194, pp. 817–818, XP002040689 Das, N. et al. "Microstrip Rectangular Resonators on Ferrimagnetic Substrates" pp. 817–818.

IEEE Transactions On Antennas an Propagation, Jan., 1983, USA vol. AP–31, No. 1, ISSN 0018–926X, pp. 188–190, XP002040690 Das, N. et al. "Circular Microstrip Antenna on Ferrimagnetic Substrate" p. 188.

Patents Abstracts of Japan, vol. 018, No. 311 (E–1561), Jun. 14, 1994 & JP 06 069057 A (Taiyo Yuden Co. Ltd), Mar. 11, 1994–Abstract–.

Wireless World, Sep. 1977, UK, vol. 83, No. 1501, ISSN 0043–6062, pp. 47–48, XP002040691 Thoday R.D.C "Band II Ferrite Aerial Unit" p. 47, paragraph 3.

*Primary Examiner*—Frank G. Font
*Assistant Examiner*—Roy M. Punnoose
*Attorney, Agent, or Firm*—Ostrolenk, Faber, Gerb & Soffen, LLP

[57] ABSTRACT

A miniature chip antenna suitable for use in low-frequency-band mobile communications is disclosed. The chip antenna has a rectangular-prism-shaped base member provided with a mounting surface. Disposed within the base member is a conductor spirally wound along the height of the base member. The base member is formed from e.g., ferrite comprising Ni—Zn having a relative magnetic permeability of 7. The conductor is made from a metal comprising, e.g., Cu, Ni, Ag, Pd, Pt, or Au, and is formed by printing, depositing, laminating or plating. The base member and the conductor are then integrally sintered. A conductor having a rectangular cross section and spirally wound along the height of the base member is thus formed within the base member.

14 Claims, 2 Drawing Sheets

CHIP ANTENNA

BACKGROUND OF THE INVENTION

1. Field of the Invention

The present invention relates generally to chip antennas and, more particularly, to chip antennas used in mobile communications and local area networks (LAN).

2. Description of the Related Art

FIG. 3 illustrates a conventional monopole antenna 50. This antenna 50 has one conductor 51 projecting into the air substantially perpendicularly from a ground surface 52 (having a relative dielectric constant $\epsilon$ of 1 and a relative magnetic permeability $\mu$ of 1). The conductor 51 is connected at its one end 53 to a power supply V and is opened at the other end 54.

In a linear-type antenna represented by the above type of monopole antenna 50, a large conductor is required because of the operation of the antenna being in the air. In the monopole antenna 50, for example, if a wavelength in a vacuum is $\lambda o$, a conductor 51 having a wavelength of $\lambda o/4$ is needed; in a low-frequency band of 1 GHz or lower, the length of the monopole antenna 50 is 7.5 cm or longer. Thus, this type of antenna cannot be used in applications where a miniature antenna is required, such as in low-frequency mobile communications.

SUMMARY OF THE INVENTION

Accordingly, it is an object of the present invention to provide a miniature chip antenna which is usable in applications, such as low-frequency-band mobile communications, free from the above-described problem.

In order to achieve the above object, according to the present invention, there is provided a chip antenna comprising: a base member made from a material having a relative magnetic permeability $\mu$ which satisfies the condition of: $7 \leqq \mu < 35$; at least one conductor formed at least one on a surface the base member and inside the base member; and at least one feeding terminal for applying a voltage to the conductor, disposed on a surface of the base member.

In the aforedescribed chip antenna, since the base member is formed using a material having a relative magnetic permeability $\mu$ which satisfies the condition of: $7 \leqq \mu \leqq 35$, the antenna possesses a wavelength-shortening effect.

The above conductor may comprise a metal comprising a substance selected from copper (Cu), nickel (Ni), silver (Ag), palladium (Pd), platinum (Pt), and gold (Au).

More specifically, the conductive patterns forming the conductor are formed using a metal comprising at least one of copper, nickel, silver, palladium, platinum and gold. This makes it possible to integrally sinter the base member and the conductive patterns.

Other features and advantages of the present invention will become apparent from the following description of the invention which refers to the accompanying drawings.

DETAILED DESCRIPTION OF EMBODIMENTS OF THE INVENTION

Figure 1:
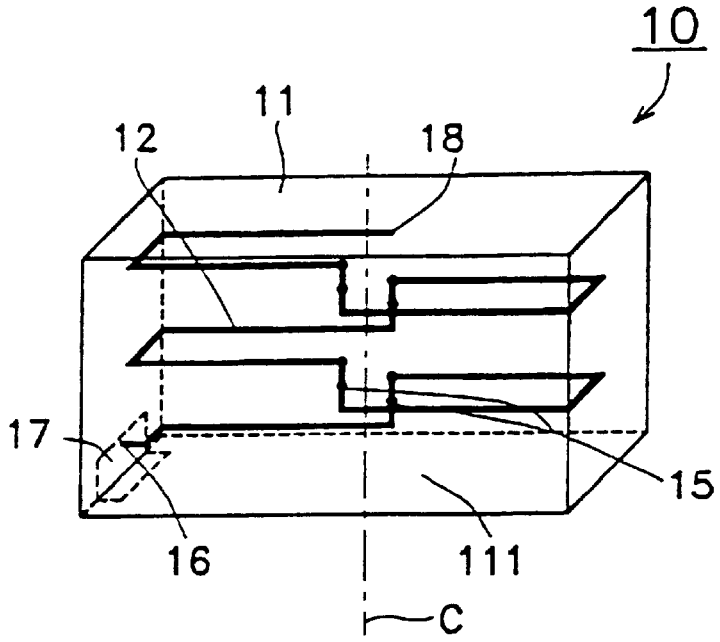
FIG. 1 is a perspective view illustrating a chip antenna according to an embodiment of the present invention.
Figure 3:
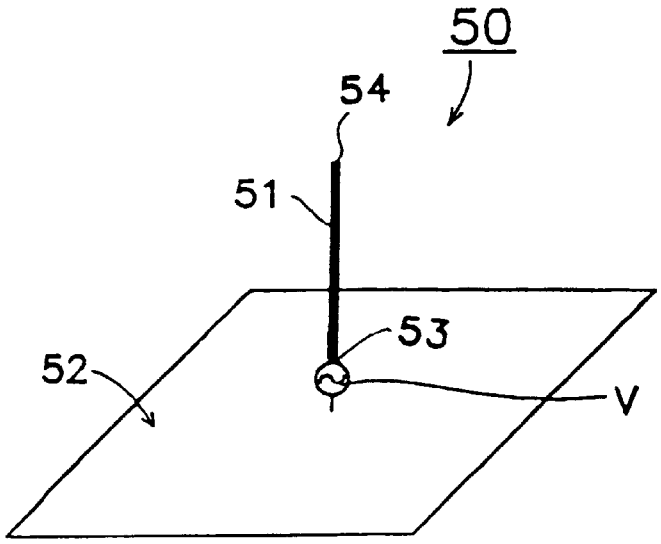
FIG. 3 illustrates a conventional monopole antenna.
Figure 2:
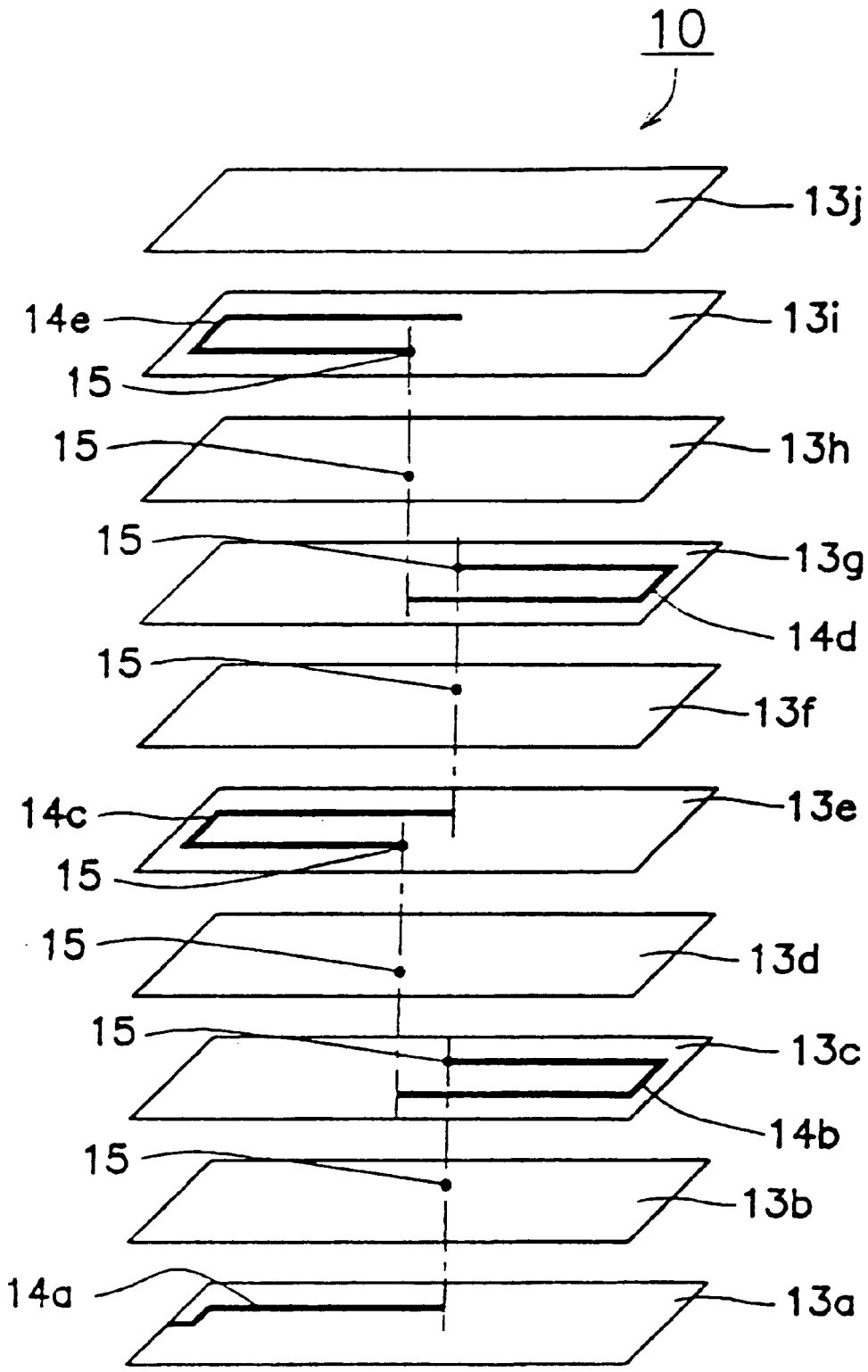
FIG. 2 is an exploded perspective view of the chip antenna shown in FIG. 1.

Referring to FIG. 1, a chip antenna 10 is formed of a rectangular-prism-shaped base member 11 provided with a mounting surface 111. Disposed within the base member 11 is a conductor 12 spirally wound in a direction in which its winding axis C is perpendicular to the mounting surface 111, i.e., in a direction along the height of the base member 11. The base member 11 is made from ferrite comprising nickel(Ni)—zinc(Zn), and is formed, as illustrated in FIG. 2, by laminating rectangular sheet layers 13*a* through 13*j* having a relative magnetic permeability of 7 to 35, as indicated in Table 1.

TABLE 1

| Material no. | Relative magnetic permeability | Threshold frequency |
|---|---|---|
| 1 | 7 | 120 MHz |
| 2 | 15 | 80 MHz |
| 3 | 25 | 70 MHz |
| 4 | 30 | 50 MHz |
| 5 | 35 | 40 MHz |

The threshold frequency shown in Table 1 designates the frequency at which the substantially-constant Q-factor in a low-frequency band is halved and thus indicates the upper-limit frequency at which the corresponding material is allowed to be used.

Among the sheet layers 13*a* through 13*j* having the constant relative permeability shown in Table 1, disposed on the surfaces of the sheet layers 13*a*, 13*c*, 13*e*, 13*g* and 13*i* by means such as printing, depositing, laminating or plating are conductive patterns 14*a* through 14*e*, respectively, generally formed in an "L" shape or an angular "U" shape and made from a metal comprising Cu, Ni, Ag, Pd, Pt, or Au, as indicated in Table 2. Further, via-holes 15 are provided in predetermined positions (one end of each of the conductive patterns 14*a* through 14*e* and its corresponding portion) of the sheet layers 13*b* through 13*i* along their thickness for connecting the patterns on the various layers together into a continuous conductor after lamination.

The sheet layers 13*a* through 13*j* are then laminated, and the base member 11 and the conductive patterns 14*a* through 14*e* are integrally sintered under the conditions shown in Table 2, followed by connecting the conductive patterns 14*a* through 14*e* through the via-holes 15. The conductor 12 having a rectangular cross section and wound along the height of the base member 11 is thus formed within the base member 11.

TABLE 2

| Metal | Integrally-sintering atmosphere | Integrally-sintering temperature |
|---|---|---|
| Cu | in reducing atmosphere | 1000° C. or lower |
| Ni | in reducing atmosphere | 1000 to 1250° C. |
| Ag—Pd alloy | in air | 1000 to 1250° C. |
| Pt. | in air | 1250° C. or higher |
| Ag | in air | 900° C. or lower |

With this construction, one end (one end of the conductive pattern 14*a*) of the conductor 12 forms a feeding portion 16 which is led to a surface of the base member 11 and is connected to a feeding terminal 17 for applying a voltage to the conductor 12. The other end (one end of the conductive pattern 14*e*) of the conductor 12 forms a free end 18 within the base member 11. Table 3 shows the resonant frequency, the standing wave ratio (SWR), and the relative bandwidth of the chip antenna 10 measured when the sheet layers 13*a* through 13*j* forming the base member 11 use the respective materials. It should be noted that the shapes of the base member 11 and the conductor 12 of the chip antenna 10 using the magnetic material Nos. 1–5 shown in Table 1 were fixed, and an impedance matching circuit was added to the chip antenna 10 when its characteristics were measured.

TABLE 3

| Material No. | Resonant frequency | SWR | Relative bandwidth |
|---|---|---|---|
| 1 | 96.8 MHz | 1.32 | 1.2 |
| 2 | 65.1 MHz | 1.21 | 1.0 |
| 3 | 51.5 MHz | 1.33 | 1.0 |
| 4 | 47.2 MHz | 1.18 | 0.8 |
| 5 | 42.0 MHz | Matching not obtained | Matching not obtained |

Material Nos. shown in 3 correspond to material Nos. shown in Table 1.

Although material No. 5 achieved a resonant frequency of 42.0 MHz, SWR was measured at approximately 20 and impedance matching could not be obtained.

Table 3 reveals that the chip antenna using a material having a relative magnetic permeability of 35 (material no. 5 in table 3) cannot achieve impedance matching and fails to exhibit antenna characteristics accordingly. It is seen, therefore, that a magnetic material having a relative magnetic permeability $\mu$ which satisfies the condition of $7 \leqq \mu \leqq 35$ is suitably used for low-frequency-band chip antennas.

Upon comparing the dimensions of the monopole antenna 50 having a resonant frequency of 47.2 MHz with the dimensions of the chip antenna 10 having the same resonant frequency produced from material No. 4 shown in table 1, the length of the monopole antenna 50 is approximately 158 cm, while the chip antenna 10 is 5 mm wide, 8 mm deep, and 2.5 mm high, which depth dimension is about 1/200 of the length of the monopole antenna 50. Further, in a low-frequency band of 1 GHz or lower in which the length of the monopole antenna 50 is 7.5 cm or longer, the depth dimension of the chip antenna 10 is one ninth or smaller than the length of the monopole antenna 50.

According to the above description, in this embodiment the dimension of a chip antenna using a material having a relative magnetic permeability $\mu$ which meets the condition of $7 \leqq \mu < 35$ can be reduced to one ninth or smaller than known monopole antennas in a low-frequency band of 1 GHz or lower while satisfying the required antenna characteristics. It is thus possible to produce a downsized antenna suitable for use in a low-frequency-band mobile communication unit. Additionally, the base member and the conductive patterns forming the conductor can be integrally sintered, thereby reducing the steps and cost for the manufacturing process.

The above embodiment has been explained such that ferrite comprising Ni—Zn is used as a magnetic material. This material is, however, provided by way of an example only, and any magnetic material may be used as long as its relative magnetic permeability $\mu$ satisfies the condition of $7 \leqq \mu < 35$, for example, a material comprising nickel, cobalt and iron.

Moreover, although the base member is in the shape of a rectangular-prism, it may be another shape, such as a cube, a cylinder, a pyramid, a cone, or a sphere.

In this embodiment the conductor is spirally wound in a direction perpendicular to the mounting surface of the base member. The conductor may be, however, wound in a direction parallel to the mounting surface of the base member. Also, although the cross section of the conductor orthogonal to its winding axis is generally rectangular, it may be another shape as long as it has a partial linear portion. Further, although the above embodiment has been described such that the conductor is spirally wound, it may be formed in a meandering shape.

In this embodiment the conductor is provided within the base member. The conductor may be, however, partially or wholly disposed on a surface of the base member. Further, although only one conductor is used in this embodiment, two or more conductors may be formed, in which case, the resulting antenna has a plurality of resonant frequencies.

Additionally, the position of the feeding terminal is not an essential condition to carry out the present invention.

As is seen from the above description, the chip antenna of the present invention offers the following advantages.

The base member of the chip antenna is formed using a material having a relative magnetic permeability $\mu$ that meets the condition of $7 \leqq \mu < 35$, which makes it possible to shorten the wavelength, thereby further reducing the dimension of the conductor. Accordingly, the conductor can be downsized, for example, to one ninth or smaller than conventional monopole antennas in a low frequency band of 1 GHz or lower while satisfying the required antenna characteristics. Hence, a miniature antenna suitable for use in a low-frequency-band mobile communication unit can be manufactured.

Further, if the conductor is made from a metal comprising copper, nickel, silver, palladium, platinum, or gold, the base member and the conductive patterns forming the conductor can be integrally sintered, thereby shortening the manufacturing process steps and reducing the cost.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a base member made from a material having a relative magnetic permeability $\mu$ which satisfies the condition of $7 \leqq \mu < 35$;

at least one conductor formed at least one of on a surface of the base member and inside said base member; and at least one feeding terminal for applying a voltage to said conductor disposed on a surface of said base member.

2. The chip antenna of claim 1, wherein said conductor comprises a metal comprising at least one of copper, nickel, silver, palladium, platinum and gold.

3. The chip antenna of claim 1, wherein the base member comprises a plurality of layers laminated together, selected ones of the layers having a portion of said conductor thereon, the portions of the conductor being connected together by through-holes disposed in selected ones of said layers after said layers are laminated together.

4. The chip antenna of claim 1, wherein the conductor forms a spiral having a winding axis.

5. The chip antenna of claim 1, wherein the winding axis is perpendicular to a mounting surface of the base member.

6. The chip antenna of claim 1, wherein the base member comprises ferrite.

7. The chip antenna of claim 6, wherein the ferrite base member comprises nickel-zinc.

8. The chip antenna of claim 1, wherein the conductor has one free unconnected end, another end being connected to the feeding terminal.

9. The chip antenna of claim 4, wherein the conductor spiral has a rectangular or square cross-section.

10. The chip antenna of claim 1, wherein the base member is in the shape of a rectangular prism, cube, cylinder, pyramid, cone or sphere.

11. The chip antenna of claim 2, wherein the conductor and the base member are integrally sintered.

12. The chip antenna of claim 1, wherein the base member comprises nickel, cobalt and iron.

13. The chip antenna of claim 1, wherein the conductor is formed by at least one of printing, depositing, laminating and plating.

14. The chip antenna of claim 1, wherein the conductor has a meandering shape.

* * * * *